US007937902B1

(12) United States Patent
Smith et al.

(10) Patent No.: US 7,937,902 B1
(45) Date of Patent: May 10, 2011

(54) RAIN SCREEN SYSTEM

(76) Inventors: Stewart Smith, Wayland, MA (US); Andrew D Smith, Charlton, MD (US)

( * ) Notice: Subject to any disclaimer, the term of this patent is extended or adjusted under 35 U.S.C. 154(b) by 211 days.

(21) Appl. No.: 12/389,247

(22) Filed: Feb. 19, 2009

Related U.S. Application Data

(60) Provisional application No. 61/066,248, filed on Feb. 19, 2008.

(51) Int. Cl.
*E04B 2/00* (2006.01)

(52) U.S. Cl. ..... 52/235; 52/302.1; 52/506.06

(58) Field of Classification Search ..... 52/235, 52/209, 302.1, 546, 547, 506.06, 506.08, 52/511, 512
See application file for complete search history.

(56) References Cited

U.S. PATENT DOCUMENTS

| | | | | |
|---|---|---|---|---|
| 4,566,234 | A * | 1/1986 | Held | 52/209 |
| 4,685,263 | A * | 8/1987 | Ting | 52/235 |
| 4,866,896 | A * | 9/1989 | Shreiner et al. | 52/235 |
| 4,984,402 | A * | 1/1991 | Davies | 52/204.593 |
| 5,184,440 | A | 2/1993 | Felix et al. | |
| 5,544,461 | A | 8/1996 | Sommerstein | |
| 5,956,910 | A | 9/1999 | Sommerstein et al. | |
| 6,170,214 | B1 | 1/2001 | Treister et al. | |
| 6,425,218 | B1 * | 7/2002 | Doyon et al. | 52/235 |
| 6,505,448 | B2 | 1/2003 | Ito | |
| 7,043,884 | B2 | 5/2006 | Moreno | |
| 7,134,247 | B2 * | 11/2006 | Ting | 52/235 |
| 7,272,913 | B2 * | 9/2007 | Mitchell | 52/235 |
| 7,614,191 | B2 * | 11/2009 | Mitchell | 52/235 |
| 7,716,891 | B2 * | 5/2010 | Radford | 52/506.08 |
| 2007/0022682 | A1 * | 2/2007 | Morgenegg et al. | 52/235 |
| 2009/0241451 | A1 * | 10/2009 | Griffiths | 52/309.4 |

* cited by examiner

*Primary Examiner* — B. Glessner
*Assistant Examiner* — Brent W Herring
(74) *Attorney, Agent, or Firm* — Gerry A. Blodgett; Blodgett & Blodgett, P.C.

(57) ABSTRACT

A rain screen system for attaching an array of panels to the outside of a building, by means of a track system. The track system includes a series of horizontal mounting tracks that extend across the entire width of the panel array. Each horizontal mounting track has an upturned building-side leg that forms both a mounting flange, through a local shim, to the building, as well as the building side of a water tight, continuous, self draining gutter system. Each track also has an upturned panel-side leg that forms both a mounting flange for the lower edge of a panel and the panel side of the gutter system. Each track also forms a water seal at the top edge of the panel. The gutter system has a weep holes on the panel side of the gutter system, adapted so that drainage is fed to the top of the lower panel.

11 Claims, 6 Drawing Sheets

RAIN SCREEN SYSTEM

CROSS-REFERENCE TO RELATED APPLICATIONS

This application claims the benefit under 35 U.S.C. section 119(e) of U.S. Provisional patent application No. 61/066,248 filed Feb. 19, 2008, all of which is hereby incorporated by reference.

STATEMENT REGARDING FEDERALLY SPONSORED RESEARCH OR DEVELOPMENT

This invention has been created without the sponsorship or funding of any federally sponsored research or development program.

REFERENCE TO SEQUENCE LISTING, A TABLE, OR A COMPUTER PROGRAM LISTING COMPACT DISK APPENDIX

Not applicable.

THE FIELD OF THE INVENTION

This invention involves a system for protecting the outside of a building from weather and beautifying the building.

BACKGROUND OF THE INVENTION

It is common to protect and beautify the outside of a building by attaching a matrix of panels to the outside of the building, but spaced from the outside of the building by a support structure. These systems are typically called Rain Screen Wall Cladding Systems, Pressure-Equalized Rain Screen Wall Cladding Systems, or simply Rain Screens. The panels protect the outside of the building from the direct effects of weather, and the spacing between the panels and the outside of the building enhance the weather-protecting features, prevent moisture accumulation between the panels and the outside of the building, and provide an insulating layer.

Currently available rain screen systems suffer from a number of performance features that are not always optimum.

First of all, many of the currently available rain screen systems do not allow highly efficient and effective installation of the systems on the buildings, and do not allow highly efficient removal and reinstallation of panels as necessary for maintenance.

Many currently available rain screen systems allow too much rain into the spacing between the outer panels and the outer wall of the building. Sometimes this is caused by failure of the various sealing mechanisms between and around the panels.

In general, water leakage into the space between the rain screen and the building, the building envelope, is driven by five forces: kinetic forces, gravity, surface tension, capillarity, and pressure differentials. Any combination of these forces can be acting on water entering the building envelope. The goal of a rain screen design is to eliminate or minimize their effects. Kinetic forces refer to the horizontal velocity that wind-driven rain drops possess. The momentum can carry them directly through sufficiently sized openings into the envelope interior. The actual rain screen cladding serves to keep most of this water out of the system. Gravity, capillarity, and surface tension can all be combated with appropriately design flashing or drip edges. Pressure differences between the cladding exterior and interior generated by mechanical systems, stack effects, and winds, also act to force or draw water through any openings. Pressure equalized systems are designed specifically to resist this mechanism of leakage and is an important characteristic of a well-designed rain screen system.

Thus, some rain screen systems tend to draw water into the space, because pressure differentials between the outside of the panels (high pressure) and the space between the panels (low pressure) caused by wind and the aerodynamics of the rain screen system, can actually draw water into the space between the panels in the wall. Attempts to design the rain screen systems to minimize this pressure differential are referred to as pressure equalization systems.

The importance of the pressure equalization ability as caused the suppliers of available rain screen systems to claim the feature of pressure equalization and sometimes those claims are unsubstantiated or exaggerated. As result, the American Architectural Manufacturers Association (AAMA) has established a standard (AAMA 508-7) to define pressure equalization in rain screen wall cladding systems. Not all available rain screen systems, including some that claim pressure equalization, are capable of satisfying that standard.

Furthermore, not all currently available rain screen systems provide rapid and effective drainage of any water that does enter the space between the panels in the building wall.

Finally, not all currently available rain screen systems provide rapid and effective drying of any moisture that accumulates between the panels on the wall.

These and other difficulties experienced with the prior art devices have been obviated in a novel manner by the present invention.

It is, therefore, an outstanding object of some embodiments of the present invention to provide a rain screen system that is efficient and effective to install.

It is a further object of some embodiments of the invention to provide a rain screen system that is efficient and effective to maintain.

It is a further object of some embodiments of the invention to provide a rain screen system that provides very effective sealing against rain intrusion.

It is a further object of some embodiments of the invention to provide a rain screen system that provides very effective pressure equalization.

It is a further object of some embodiments of the invention to provide a rain screen system that satisfies the AAMA 508-7 standard.

It is a further object of some embodiments of the invention to provide a rain screen system that provides efficient and effective drainage of water from between the panel and the walls.

It is a further object of some embodiments of the invention to provide a a rain screen system that provides a highly effective chimney effect to dry out any moisture between the panel on the walls.

It is a further object of some embodiments of the invention to provide a rain screen system that is capable of being manufactured of high quality and at a low cost, enjoys minimum installation costs, provides highly effective function, and which is capable of providing a long and useful life with a minimum of maintenance.

With these and other objects in view, as will be apparent to those skilled in the art, the invention resides in the combination of parts set forth in the specification and covered by the claims appended hereto, it being understood that changes in the precise embodiment of the invention herein disclosed may be made within the scope of what is claimed without departing from the spirit of the invention.

BRIEF SUMMARY OF THE INVENTION

This invention involves a rain screen system for attaching an array of panels to the outside of a building, by means of a track system. The track system includes a series of horizontal mounting tracks that extend across the entire width of the panel array. Each horizontal mounting track has an upturned building-side leg that forms both a mounting flange, through a local shim, to the building, as well as the building side of a water tight, continuous, self draining gutter system. Each track also has an upturned panel-side leg that forms both a mounting flange for the lower edge of a panel and the panel side of the gutter system. Each track also forms a water seal at the top edge of the panel. The gutter system has a weep holes on the panel side of the gutter system, adapted so that drainage is fed to the top of the lower panel.

BRIEF DESCRIPTION OF THE SEVERAL VIEWS OF THE DRAWING

The character of the invention, however, may best be understood by reference to one of its structural forms, as illustrated by the accompanying drawings, in which.

DETAILED DESCRIPTION OF THE INVENTION

This invention involves a rain screen system for attaching an array of panels to the outside of a building, by means of a track system. The track system includes a series of horizontal mounting tracks that extend across the entire width of the panel array. Each horizontal mounting track has an upturned building-side leg that forms both a mounting flange, through a local shim, to the building, as well as the building side of a water tight, continuous, self draining gutter system. Each track also has an upturned panel-side leg that forms both a mounting flange for the lower edge of a panel and the panel side of the gutter system. Each track also forms a water seal at the top edge of the panel. The gutter system has a weep holes on the panel side of the gutter system, adapted so that drainage is fed to the top of the lower panel.

The key elements of this technology are the outside of the building, the array of panels, and the tracking system and ceiling systems that attach the panels to the building and seal the panels.

Figure 1:
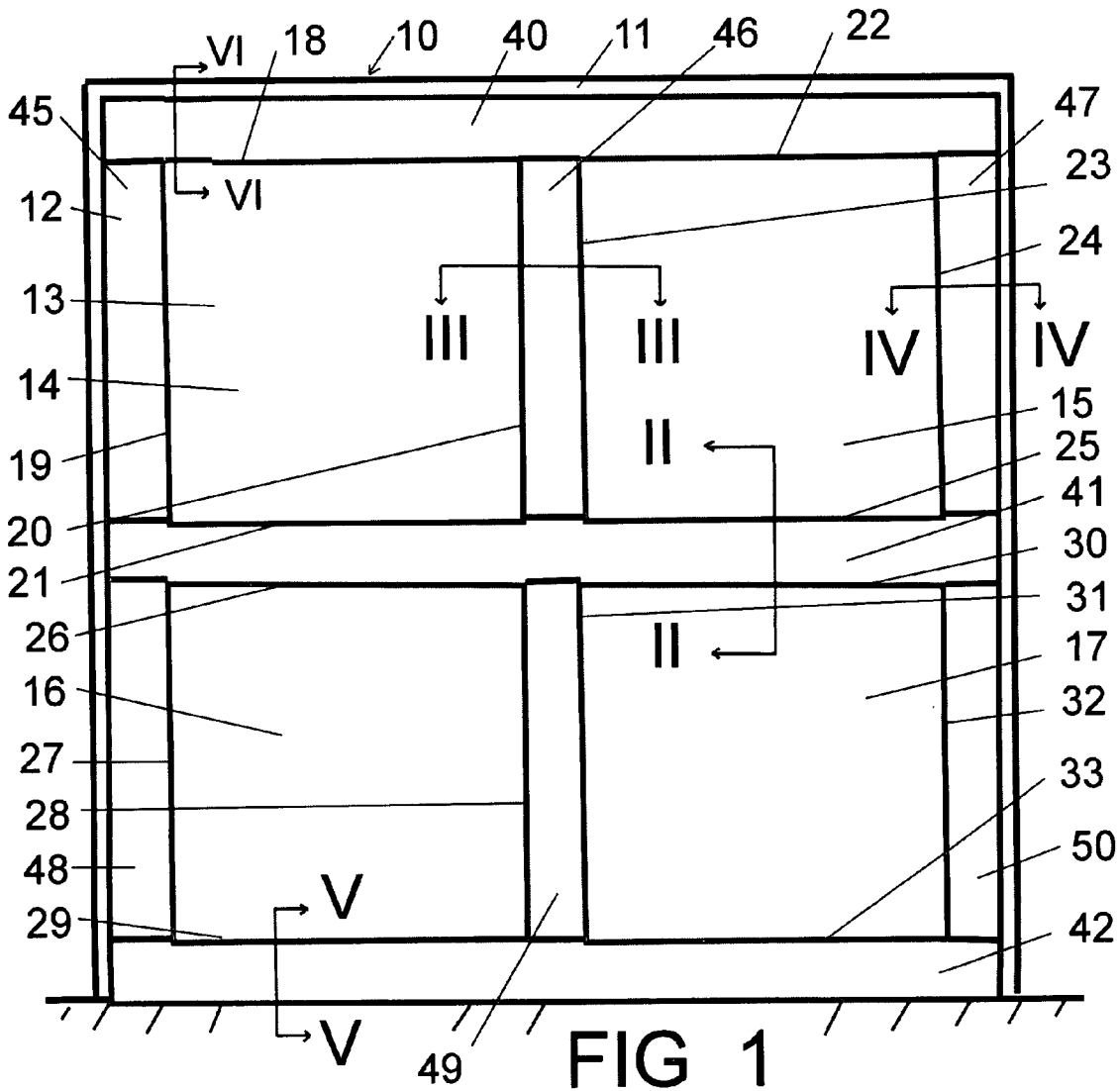
FIG. 1 is a front elevation view of a rain screen system embodying the principles of the present invention.

Referring first to FIG. 1, in which our best showing in general features of the present invention, the rain screen system, designated generally by the 10, is shown to include a building 11, a track system 12, and an array 13 of panels 14, 15, 16, and 17. Panel 14 has a top edge 18, two side edges 19 and 20, and a bottom edge 21. Panel 15 has a top edge 22, two side edges 23 and 24, and a bottom edge 25. Panel 16 has a top edge 26, two side edges 27 and 28, and a bottom edge 29. Panel 17 has a top edge 30, two side edges 31 and 32, and a bottom edge 33.

The track system 12 includes a plurality of horizontal mounting tracks 40, 41, and 42, that extend continuously across the width of the panel array 13. The track system 12 also includes a plurality of vertical mounting tracks 45, 46, 47, 48, 49, and 50.

The term "extrusion" is frequently used to describe various elements of this system. It should be understood that the elements on which this term are used have a general characteristics of an extruded part, generally consistent cross-section, but are not necessarily manufactured by that process. i) ii) Furthermore, even if they are manufactured by the extrusion process, they are frequently subject to post formation processing.

Figure 2:
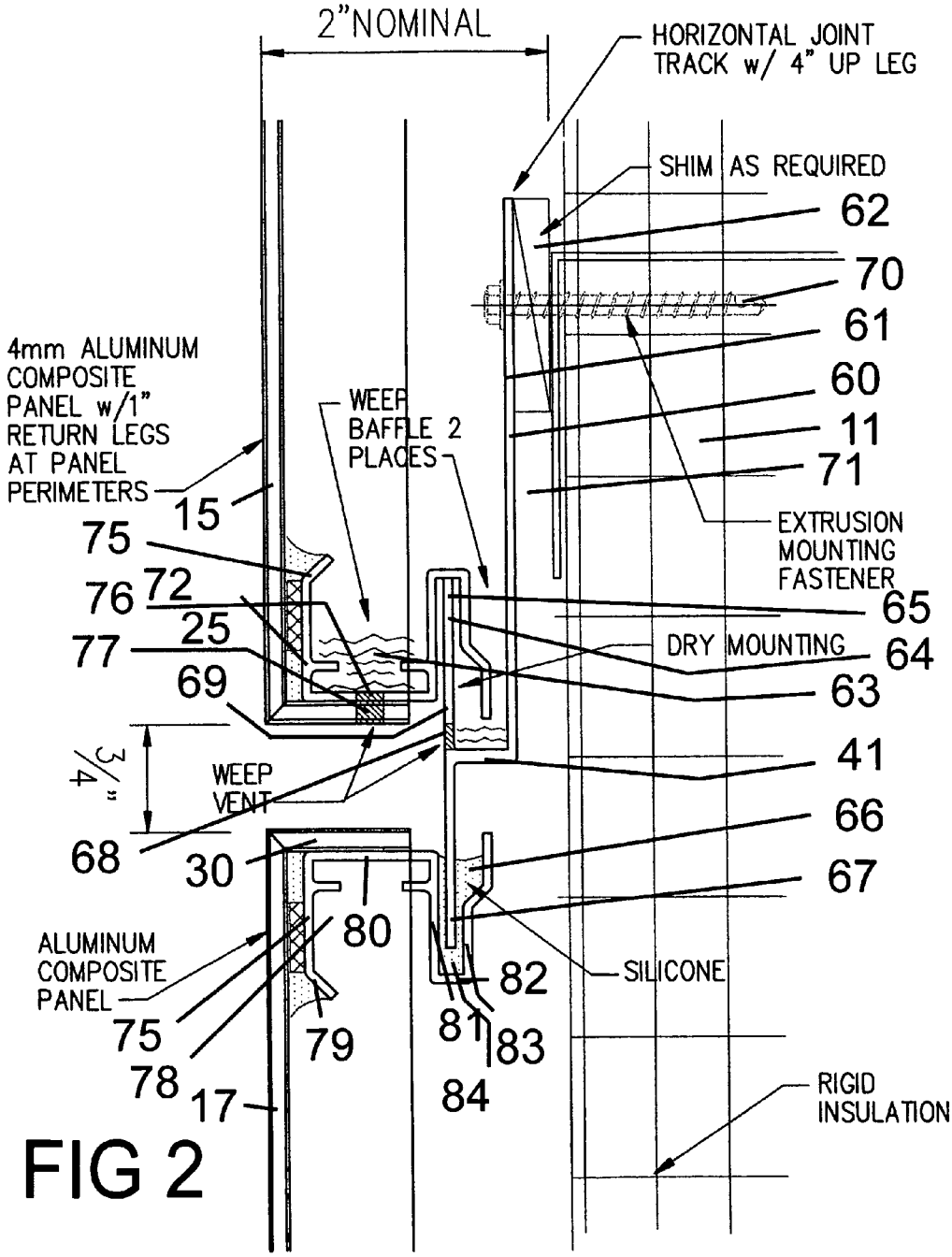
FIG. 2 is a sectional view taken along line II-II of FIG. 1.

Referring now to FIG. 2, which is a sectional view taken along line II-II of FIG. 1, the cross-sectional view of the horizontal mounting track 41 and its relationship to the other elements of the system are shown. The cross-sectional profile of the horizontal track 41 is consistent through its length. However, in the preferred embodiment of this invention, gutter weep holes, discussed below, are present throughout its length, and the ends are sealed.

The horizontal mounting track 41 is shown to have an upturned building-side leg 60 that forms both a mounting flange 61, that uses a screw fastener 70, through a local shim 62, to the building 11, as well as the building side of a water-tight, continuous, self draining gutter system 63. The shims 62 are thin and narrow, so that there is a thin, but significant air passage 71 between the mounting flange 61 and the building 11 to provide ventilation and chimney effect up the wall of the building 11. This chimney effect encourages rapid drying of any moisture between the panels and the building 11. Each track 41 also has an upturned panel-side leg 64 that forms both a mounting flange 65 for the lower edge 25 of a panel 15 and the panel side 69 of the gutter system 63. Each track 41 also forms a water seal 66 at the top edge 30 of the panel 17. In a preferred embodiment of this invention, each track 41, has a downturned leg 67 that engages the top edge 30 of the panel 17 to form the water seal 66. The gutter system 63 has gutter weep holes 68 on the panel side of the gutter system 63, adapted so that drainage is fed to the top 30 of the lower panel 17. In the preferred embodiment of this invention, the gutter weep holes 68 pass-through the lower edge 69 of the upturned panel-side leg 64.

In a preferred embodiment of this invention, the connection between the panel and the horizontal mounting track, and in fact all of the horizontal and vertical mounting tracks, is a corner exclusion 75, uniform throughout the system, except that the corner extrusions 75 that are mounted in sealed to the lower edges of the panels have downward facing weep holes 76 that correspond to weep holes 77 in the bottom panel edges to allow drainage of the corner extrusions. The corner exclusions 75 not only provide a means for attaching the panels to the horizontal and vertical mounting track, but also provide structural reinforcement for the entire periphery of each panel.

Each corner extrusions 75 includes a three-sided gutter 78 that is open toward the center of the panel. These sides of the gutter 78 are the panel side wall 79, the gutter up bottom 80 and the building side wall 81. At the interior edge 82 of the building side wall 81 is a reentrant element 83 that bends back and out toward the edge of the panel to form an engagement groove 84 that is adapted to engage (and, and in the case of side and top edges of each panel, seal with) panel-side legs on the mounting tracks.

Figure 3:
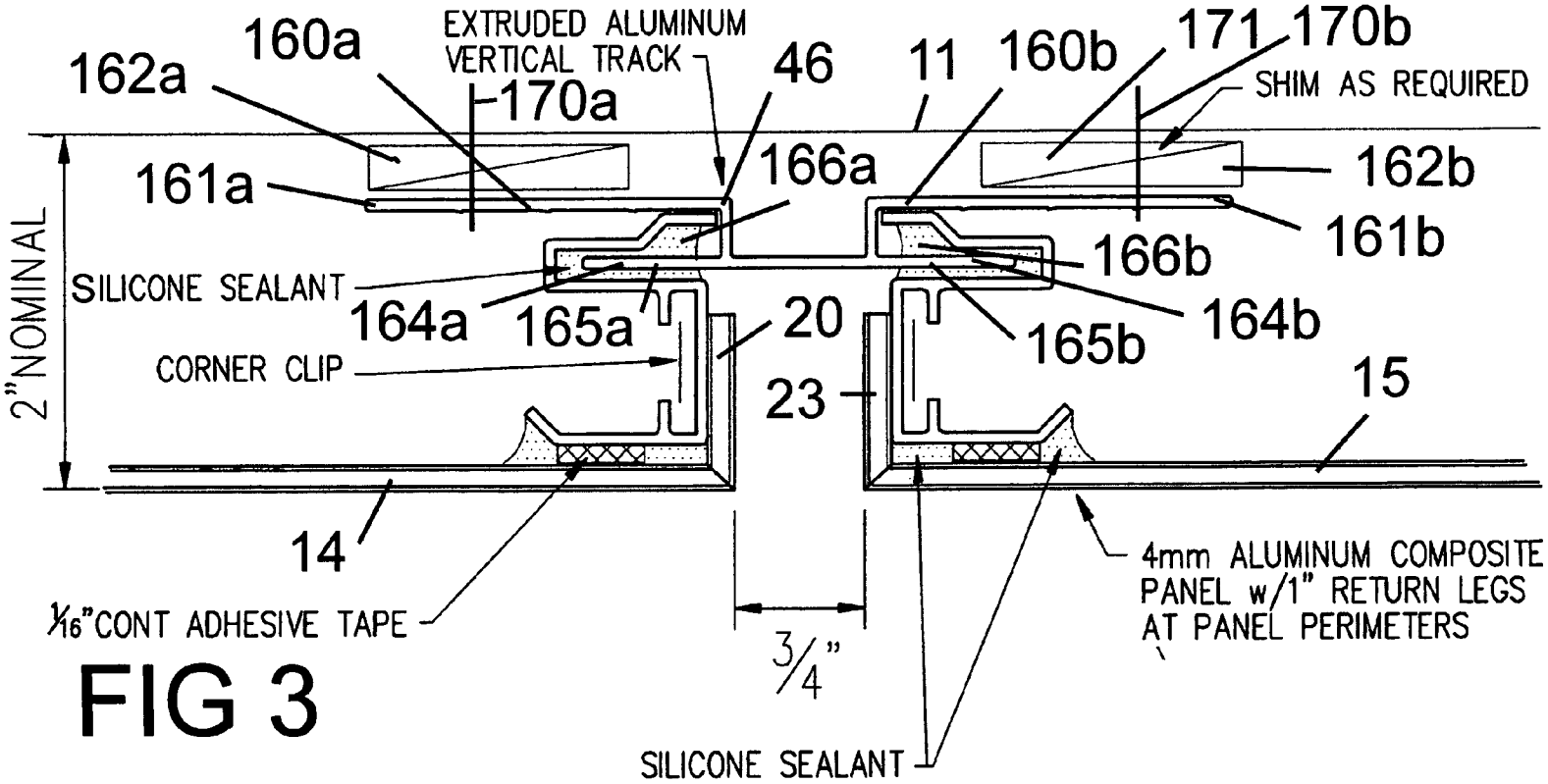
FIG. 3 is a sectional view taken along line III-III of FIG. 1.

FIG. 3 is a sectional view taken along line III-III of FIG. 1, generally showing a plan view of the vertical elements of the structure as it holds the side edges 20 and 23 of two panels 14 and 15 respectively. The cross-sectional profile of the vertical track 46 is consistent through its length.

The vertical mounting track 46 is shown to have an sideways turned building-side legs 160*a* and 160*b* that form a mounting flange 161*a* and 161*b*, that use a screw fastener

170*a* and 170*b*, through a local shims 162*a* and 162*b*, to the building 11. The shims 162*a* and 162*b* are thin and narrow, so that there is a thin, but significant air passage 171 between the mounting flanges 161*a* and 161*b* and the building 11 to provide ventilation. Each track 46 also has an sideways turned panel-side legs 164*a* and 164*b* that form mounting flanges 165*a* and 165*b* for the side edge 20 of a panel 14 and the side edge 23 of panel 15. Each track 46 forms a water seal 166*a* and 166*b* with the side edge 20 of a panel 14 and the side edge 23 of panel 15.

Figure 4:
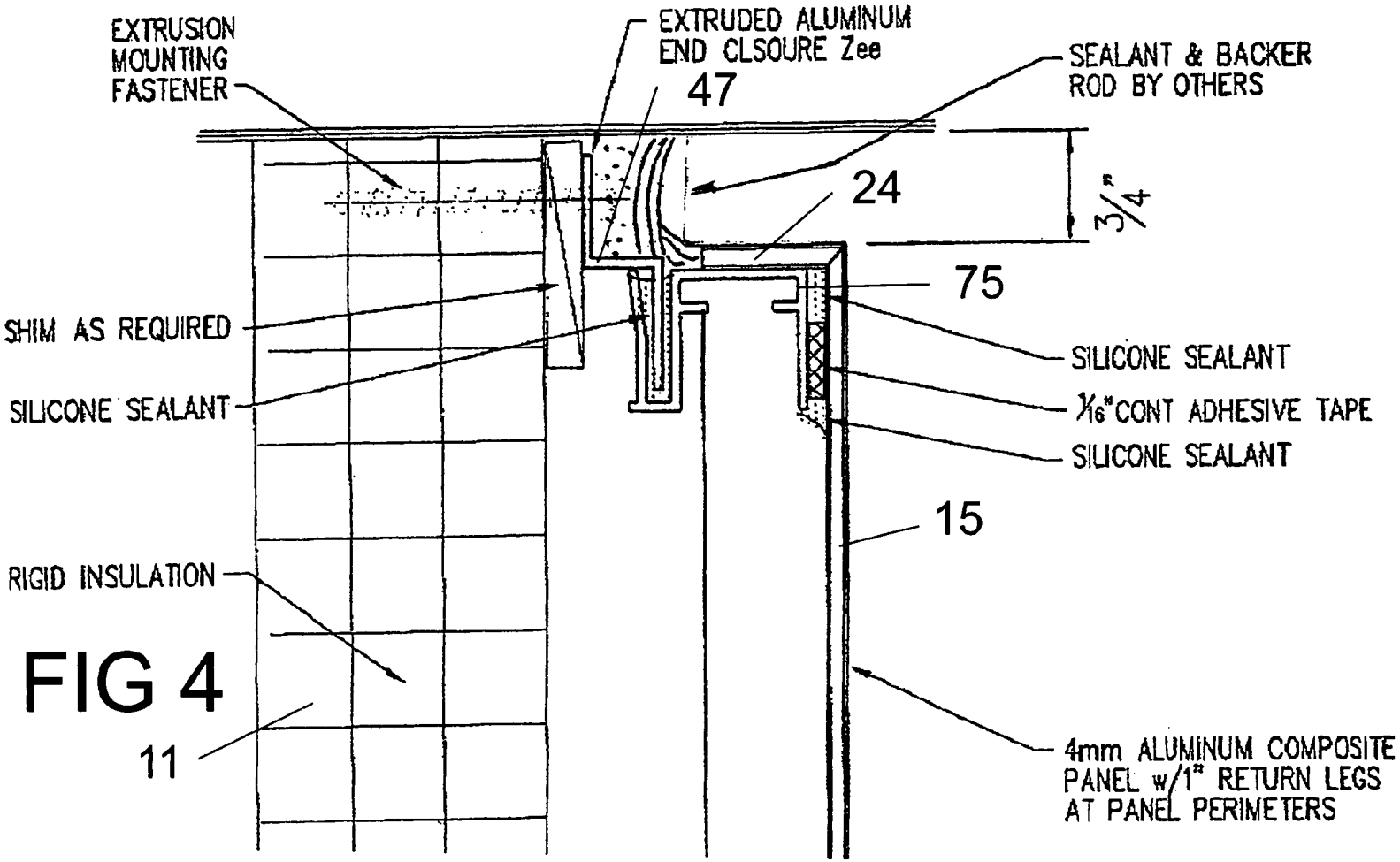
FIG. 4 is a sectional view taken along line IV-IV of FIG. 1.

FIG. 4 is a sectional view taken along line IV-IV of FIG. 1, generally showing a plan view of the vertical elements of the structure at the right hand edge (facing the panels) of the system. More specifically, FIG. 4 shows how the vertical edge mounting track 47 is connected to the building 11 and to corner extrusion 75 mounted at the side edge 24 of panel 15. The manner of this function is consistent with the functions described above.

Figure 5:
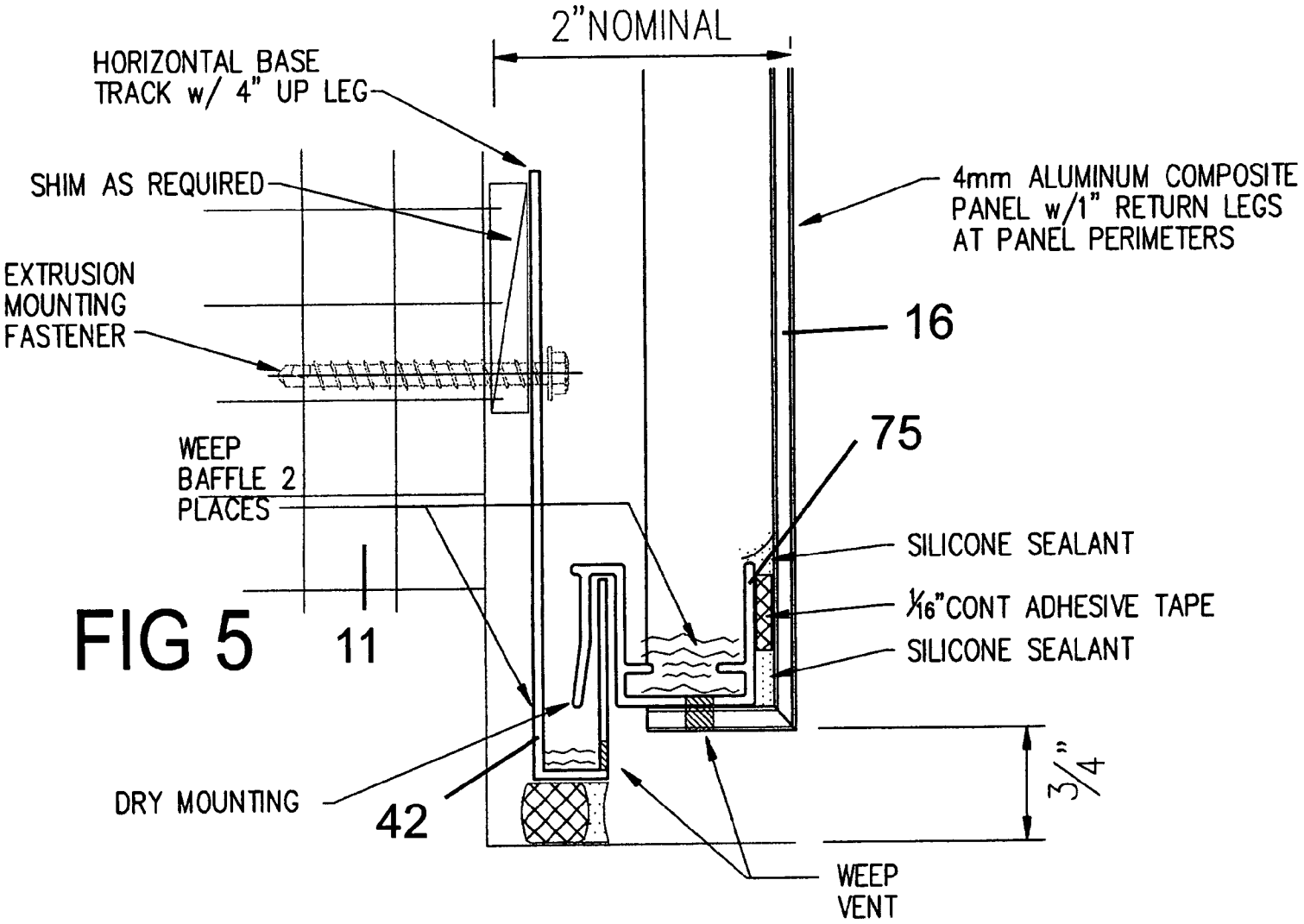
FIG. 5 is a sectional view taken along line V-V of FIG. 1.

FIG. 5 is a sectional view taken along line V-V of FIG. 1, generally showing a left elevation view of the horizontal elements at the bottom edge of system, with the elements holding the bottom edge of a panel. More specifically, FIG. 5 shows how the horizontal bottom edge mounting track 42 is connected to the building 11 and to the corner extrusion 75 mounted on the bottom edge 29 of panel 16. The manner of this function is consistent with the functions described above.

Figure 6:
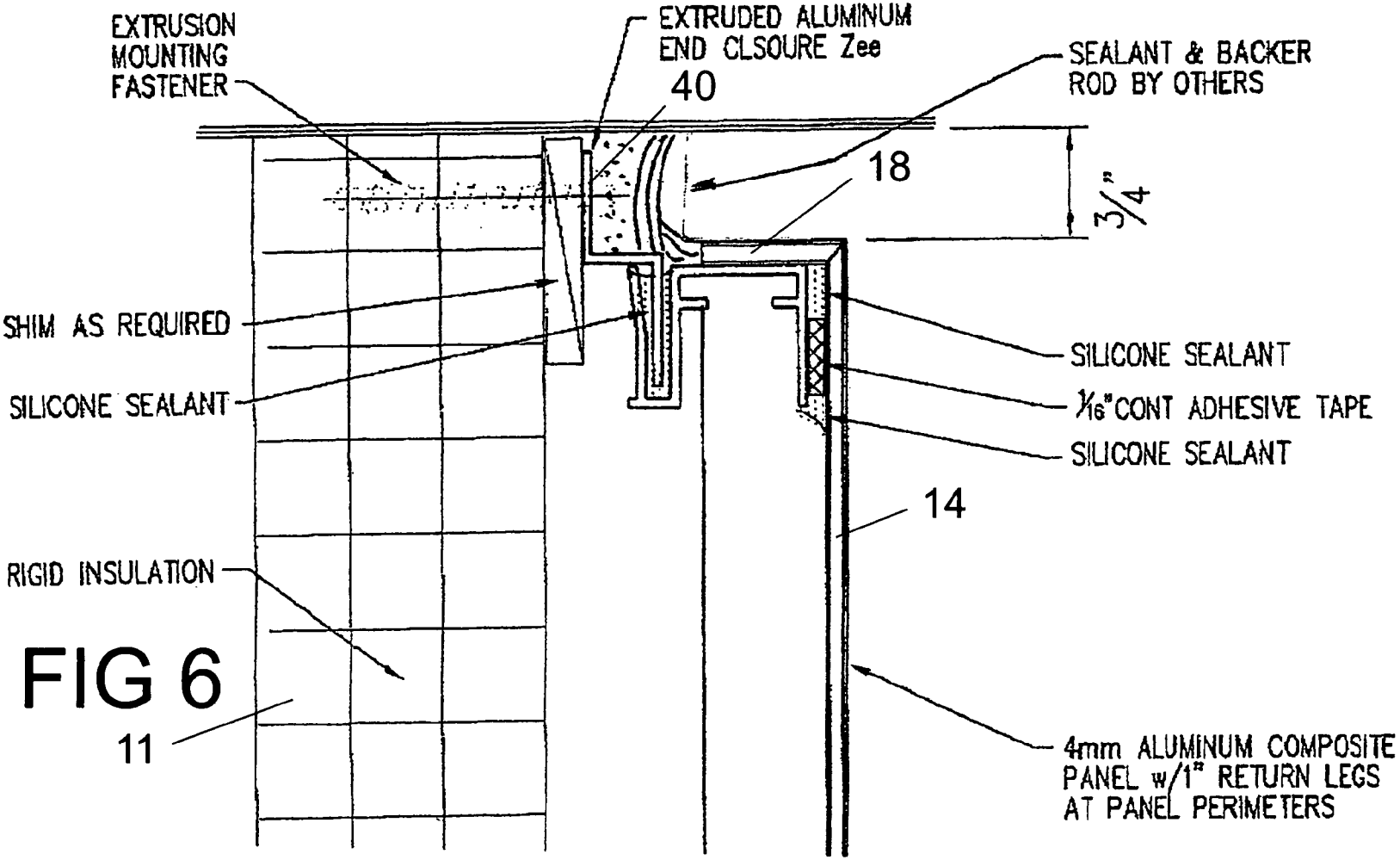
FIG. 6 is a sectional view taken along line VI-VI of FIG. 1.

FIG. 6 is a sectional view taken along line VI-VI of FIG. 1, generally showing a left elevation view of the horizontal elements of the top edge of the system, with the elements holding the top edge of a panel. More specifically, FIG. 6 shows how the horizontal top edge mounting track 40 is connected to the building 11 and to the corner extrusion 75 mounted on the top edge 18 of panel 14. The manner of this function is consistent with the functions described above.

AAMA 508-07 Test Specimen Description: The wall was constructed of four 4' wide by 4' high aluminum composite panels that had an overall thickness of 0.160". A 90° bend was utilized on all four sides of the panels. The edges of the panels were secured to an extruded aluminum panel frame member with aluminum pop rivets located ¾" from each panel corner and spaced 9¼" on center on all sides. The panel frame member corners utilized an aluminum corner key, secured to the panel with the corner pop rivets. The aluminum panel frame members were secured to the vertical and horizontal frame members with silicone along the sides and head of each panel. Extruded aluminum vertical and horizontal framing members were secured to the test wall with #8×2" long drywall screws two at the center horizontal member spaced 16" on center into the wood stud. The head frame member was secured with #8×2" long drywall screws located 5½" from each end and spaced 16" on center into the wood studs. The side framing members were secured with #8×2" long drywall screws 7½" from the head and spaced 16" on center. The bottom framing member was secured with #8×2" long drywall screws located 1½" from each side and spaced 16" on center into the wood studs. A 3" wide by ⅜" tall weeps were utilized at the bottom of each panel, located 6" from each end. Four 3" wide by ⅜" tall weeps were cut from the middle horizontal members below each panel weep. Each weep was covered with two layers of battling material secured to the panel with silicone.

Test Set-Up: The panel system was installed onto an 8' wide by 8' high 2×6 Spruce-Pine-Fir wood stud wall. The studs were spaced 16" on center inside a 2×10 wood buck. The stud wall was covered with a ⅛" thick sheet of clear lexan, sealed and secured to the exterior of the wall to simulate an air/water barrier. The wall panel system was then installed onto the lexan in a manner consistent with normal construction procedures for the system. The lexan was calibrated to a pre-determined air leakage rate by drilling ⅛" diameter holes in the backside of the acrylic, in a uniform pattern, making sure to create an even pressure drop and leakage rate across the wall and in each quadrant. The test satisfied the AAMA 508-07 pressure equalization standard.

In one embodiment, the invention could be described as a rain screen system for attaching an array of panels to the outside of a building, comprising an array of panels each panel having a top edge, to side edges, and a bottom edge, an outside surface of a building, and a track system adapted to attach the array of panels to the outside surface of the building, the tracking system comprising, a series of horizontal mounting tracks, each of which extends across the entire width of the panel array, each horizontal mounting track having an upturned building-side leg that forms both a mounting flange, through a local shim, to the building, as well as the building side of a water-tight, continuous, self draining gutter system, each track also has an upturned panel-side leg that forms both a mounting flange for the lower edge of a panel and the panel side of the gutter system, each track also forms a water seal at the top edge of the panel, the gutter system has gutter weep holes on the panel side of the gutter system, adapted so that drainage is fed to the top of the lower panel, a series of vertical mounting tracks that are positioned behind and providing mounting flange for the side edges of the panels, top edge horizontal mounting elements connected to the top edges of the panels and adapted to engage the downturned leg on the horizontal mounting tracks to form and a watertight connection, bottom edge horizontal mounting elements connected to the bottom edges of the panels and adapted to engage the upturned leg on the horizontal mounting tracks, and vertical mounting elements connected to the side edges of the panels and adapted to engage the mounting flanges on the vertical mounting tracks and form a watertight connection.

Optionally, the embodiment might be designed so that each track also has a downward directed leg that forms a water seal with the top edge of the panel. Optionally, the embodiment might be designed so that the gutter weep holes pass through the upturned leg. Optionally, the embodiment might be designed so that the bottom edge horizontal mounting elements include a weep hole that allows the drainage of water accumulated in the associated panel. Optionally, the embodiment might be designed so that the bottom edge of each panel include a weep hole that allows the drainage of water accumulated in the panel. Optionally, the embodiment might be designed so that the design and arrangement of parts is such that the system satisfies the requirements of American Architectural Manufacturers Association standard AAMA 508-07.

Another embodiment might be described as a rain screen system for attaching an array of panels to the outside of a building, comprising a track system adapted to attach the array of panels to the outside surface of the building, the tracking system comprising, a series of horizontal mounting tracks, each of which extends across the entire width of the panel array, each horizontal mounting track having an upturned building-side leg that forms both a mounting flange, through a local shim, to the building, as well as the building side of a water-tight, continuous, self draining gutter system, each track also has an upturned panel-side leg that forms both a mounting flange for the lower edge of a panel and the panel side of the gutter system, each track also forms a water seal at the top edge of the panel, the gutter system has gutter weep holes on the panel side of the gutter system, adapted so that drainage is fed to the top of the lower panel, a series of vertical mounting tracks that are positioned behind and providing mounting flange for the side edges of the panels, top edge horizontal mounting elements connected to the top edges of the panels and adapted to engage the downturned leg on the horizontal mounting tracks to form and a watertight connection, bottom edge horizontal mounting elements connected to the bottom edges of the panels and adapted to engage the upturned leg on the horizontal mounting tracks, and vertical mounting elements connected to the side edges of the panels and adapted to engage the mounting flanges on the vertical mounting tracks and form a watertight connection.

Optionally that embodiment might be designed so that each track also has a downward directed leg that forms a water seal with the top edge of the panel. Optionally that embodiment might be designed so that the gutter weep holes pass through the upturned leg. Optionally, the embodiment might be designed so that the bottom edge horizontal mounting elements include a weep hole that allows the drainage of water accumulated in the associated panel. Optionally, the embodiment might be designed so that the design and arrangement of parts is such that the system satisfies the requirements of American Architectural Manufacturers Association standard AAMA 508-07.

Another embodiment of the invention might be described as a mounting track for attaching an array of panels to the outside of a building, comprising an upturned building-side leg that is adapted to form both a mounting flange, through a local shim, to the building, as well as the building side of a water-tight, continuous, self draining gutter system, an upturned panel-side leg that is adapted to form both a mounting flange for the lower edge of a panel and the panel side of the gutter system, and a downturned panel-side leg that is adapted to form a mounting flange for the upper edge of a panel, wherein the gutter system has gutter weep holes to the panel side of the downturned leg. Optionally, that embodiment might be designed so that the gutter weep holes pass through the lower edge of the upturned leg.

This track also spans the support connections to form the structural backing for the panels. This track forms the sealed watertight joint at the top of the panel as well as an open, breathing, self draining joint at the bottom of the panel. The vertical track fits snugly into the horizontal track as well as the panel perimeter to provide for a watertight joint at the vertical panel joints. This track is free floating to allow for building and thermal expansion and movement. Both the base and vertical track are alodine washed to accept paint. They are painted to match the panel finish.

As part of the design, the mounting tracks are attached to the building with ¼ inch shim space which allows for minor variations in the building plane. This is also an important part of the system in that it allows for pressure equalization between panels.

The panel material is mounted on a continuous extrusion. This extrusion "hangs" on the base and vertical track. These extrusions have an integral corner clip that solidifies the corners of the panel as well as improves the weathering of the corners. This extrusion also allows for angled corner clips for panels that are not flat. This geometry allows the panel to free float on the mounting tracks to allow for thermal and building movement. It also allows for easy adjustment at installation. The geometry allows for open joints ranging from ½ inch to 1 inch wide. The panel extrusion allows for positive connection of stiffeners to the panel framework. Both the panels and base extrusions have integral weep holes that allow for further breathing and drainage.

The base track has positive end dams to contain any water forced into the system by high wind pressure. The slot in the panel extrusion is filled with sealant at the time of installation for a positive sealing of the joinery. This is all hidden from view. The panel material is attached to the panel extrusions either mechanically or with a bonding agent. This is all hidden from view. The panel material can be destructively removed from the panel extrusions in the field and replaced while the panel extrusions remain in place and the wall is not subject to further disturbance. The panel system can be adapted to accept many of the currently used panel materials available on the market today.

This system can be adapted to include a colored "spline". This system can be adapted to include gasketed joints. This system is designed to marry our wet sealed system as needed for unusual end conditions. This system has a 2" total profile. The extrusions are all "square" for ease of fabrication.

While it will be apparent that the illustrated embodiments of the invention herein disclosed are calculated adequately to fulfill the object and advantages primarily stated, it is to be understood that the invention is susceptible to variation, modification, and change within the spirit and scope of the subjoined claims. It is obvious that minor changes may be made in the form and construction of the invention without departing from the material spirit thereof. It is not, however, desired to confine the invention to the exact form herein shown and described, but it is desired to include all such as properly come within the scope claimed.

We claim:

1. A rain screen system for attaching an array of panels to the outside of a building, comprising:

(a) an array of panels, each panel having a top edge, two side edges, and a bottom edge, (b) an outside surface of a building, (c) a track system adapted to attach the array of panels to the outside surface of the building, the tracking system comprising:

(1) a series of horizontal mounting tracks, each of which extends across the entire width of the panel array, each horizontal mounting track having an upturned building-side leg that forms both a mounting flange, through a local shim, to the building, as well as the building side of a water-tight, continuous, self draining gutter system, each track also has an upturned panel-side leg that forms both a mounting flange for the lower edge of an upper panel and the panel side of the gutter system, each track also forms a water seal at the top edge of a lower panel, the gutter system has gutter weep holes on the panel side of the gutter system, adapted so that drainage is fed to the top of the lower panel, (2) a series of vertical mounting tracks that are positioned behind and provides a mounting flange for the side edges of each of the panels, (3) top edge horizontal mounting elements connected to the top edges of the panels and adapted to engage a downturned leg on the horizontal mounting tracks to form a watertight connection, (4) bottom edge horizontal mounting elements connected to the bottom edges of the panels and adapted to engage the upturned panel-side leg on the horizontal mounting tracks, and (5) vertical mounting elements connected to the side edges of the panels and adapted to engage the mounting flanges on the vertical mounting tracks and form a watertight connection.

2. A rain screen system as recited in claim 1, wherein each track also has the downturned leg forming the water seal with the top edge of the panel.

3. A rain screen system as recited in claim 1, wherein the gutter weep holes pass through the upturned leg.

4. A rain screen system as recited in claim 1, wherein the bottom edge horizontal mounting elements include a weep hole that allows the drainage of water accumulated in the associated panel.

5. A rain screen system as recited in claim 1, wherein the bottom edge of each panel include a weep hole that allows the drainage of water accumulated in the panel.

6. A rain screen system as recited in claim 1, wherein the design and arrangement of parts is such that the system satisfies the requirements of American Architectural Manufacturers Association standard AAMA 508-07.

7. A rain screen system for attaching an array of panels to the outside of a building, comprising:

(a) a track system adapted to attach the array of panels to the outside surface of the building, the tracking system comprising:

(1) a series of horizontal mounting tracks, each of which extends across the entire width of the panel array, each horizontal mounting track having an upturned building-side leg that forms both a mounting flange, through a local shim, to the building, as well as the building side of a water-tight, continuous, self draining gutter system, each track also has an upturned panel-side leg that forms both a mounting flange for the lower edge of an upper panel and the panel side of the gutter system, each track also forms a water seal at the top edge of a lower panel, the gutter system has gutter weep holes on the panel side of the gutter system, adapted so that drainage is fed to the top of the lower panel, (2) a series of vertical mounting tracks that are positioned behind and provides a mounting flange for the side edges of each of the panels, (3) top edge horizontal mounting elements connected to the top edges of the panels and adapted to engage a downturned leg on the horizontal mounting tracks to form a watertight connection, (4) bottom edge horizontal mounting elements connected to the bottom edges of the panels and adapted to engage the upturned panel side leg on the horizontal mounting tracks, and (5) vertical mounting elements connected to the side edges of the panels and adapted to engage the mounting flanges on the vertical mounting tracks and form a watertight connection.

8. A rain screen system as recited in claim 7, wherein each track also has the downturned leg forming the water seal with the top edge of the panel.

9. A rain screen system as recited in claim 7, wherein the gutter weep holes pass through the upturned leg.

10. A rain screen system as recited in claim 7, wherein the bottom edge horizontal mounting elements include a weep hole that allows the drainage of water accumulated in the associated panel.

11. A rain screen system as recited in claim 7, wherein the design and arrangement of parts is such that the system satisfies the requirements of American Architectural Manufacturers Association standard AAMA 508-07.

* * * * *